US008408315B2

(12) United States Patent
Docherty

(10) Patent No.: US 8,408,315 B2
(45) Date of Patent: Apr. 2, 2013

(54) MULTILATERAL EXPANDABLE SEAL

(75) Inventor: Euan Docherty, Alford (GB)

(73) Assignee: Smith International, Inc., Houston, TX (US)

( * ) Notice: Subject to any disclaimer, the term of this patent is extended or adjusted under 35 U.S.C. 154(b) by 610 days.

(21) Appl. No.: 12/630,184

(22) Filed: Dec. 3, 2009

(65) Prior Publication Data

US 2010/0147537 A1 Jun. 17, 2010

Related U.S. Application Data

(60) Provisional application No. 61/122,285, filed on Dec. 12, 2008.

(51) Int. Cl.
*E21B 19/16* (2006.01)
*E21B 33/12* (2006.01)

(52) U.S. Cl. ..... 166/380; 166/387; 166/242.6

(58) Field of Classification Search ..... 166/380, 166/387, 50, 241.1, 242.6, 192
See application file for complete search history.

(56) References Cited

U.S. PATENT DOCUMENTS

| | | | | |
|---|---|---|---|---|
| 2,797,893 | A | 7/1957 | McCune et al. | |
| 3,330,349 | A | 7/1967 | Owsley et al. | |
| 4,807,704 | A | 2/1989 | Hsu et al. | |
| 5,680,901 | A | 10/1997 | Gardes | |
| 5,875,847 | A | 3/1999 | Forsyth et al. | |
| 6,142,538 | A | 11/2000 | Volgstadt et al. | |
| 7,011,151 | B2 | 3/2006 | McGarian et al. | |
| 7,213,652 | B2 | 5/2007 | Hepburn et al. | |
| 7,228,915 | B2 | 6/2007 | Thomson | |
| 8,146,685 | B2 * | 4/2012 | Lee et al. | 175/61 |
| 2001/0042621 | A1 * | 11/2001 | Leising | 166/255.1 |
| 2003/0075333 | A1 * | 4/2003 | Vercaemer et al. | 166/308 |
| 2004/0159435 | A1 * | 8/2004 | Plucheck et al. | 166/313 |
| 2005/0103497 | A1 * | 5/2005 | Gondouin | 166/302 |
| 2005/0199401 | A1 | 9/2005 | Patel et al. | |
| 2005/0241834 | A1 * | 11/2005 | McGlothen et al. | 166/380 |
| 2006/0266531 | A1 | 11/2006 | Hepburn et al. | |
| 2008/0099201 | A1 | 5/2008 | Sponchia et al. | |
| 2010/0139930 | A1 * | 6/2010 | Patel et al. | 166/387 |
| 2011/0036576 | A1 * | 2/2011 | Schultz et al. | 166/303 |

FOREIGN PATENT DOCUMENTS

| | | | |
|---|---|---|---|
| CN | 201284627 | Y | 8/2009 |
| WO | 2008062186 | A1 | 5/2008 |

OTHER PUBLICATIONS

Search Report issued in the United Kingdom Intellectual Property Office for related British Application No. GB0921753.0; dated Jan. 28, 2010 (4 pages).
Partial English translation for Chinese Patent CN 201284627 Y (2 pages).

* cited by examiner

*Primary Examiner* — Daniel P Stephenson
(74) *Attorney, Agent, or Firm* — Brandon S. Clark

(57) ABSTRACT

A system for sealingly engaging multiple downhole tubulars includes a first downhole tubular, a guide assembly and a swellable seal. The first downhole tubular includes an end for receiving a second downhole tubular. The guide assembly is disposed on an end of the second tubular. A swellable seal is disposed on an outer surface of the guide assembly. After the first tubular receives a second tubular, the swellable seal is activated to form an expanded circumferential seal between the first tubular and the second tubular.

24 Claims, 4 Drawing Sheets

MULTILATERAL EXPANDABLE SEAL

CROSS-REFERENCE TO RELATED APPLICATIONS

This application, pursuant to 35 U.S.C. §119(*e*), claims priority to U.S. Provisional Application Ser. No. 61/122,285, filed Dec. 12, 2008. That application is incorporated by reference in its entirety.

BACKGROUND OF THE INVENTION

1. Field of the Invention

Embodiments disclosed herein relate to wellbore completion. More particularly, embodiments disclosed herein relate to providing a sealingly engaged connection between tubulars for completing a main or branch wellbore. Other embodiments disclosed herein pertain to activation of a swelling material to form a seal.

2. Description of the Related Art

Single or multiple branch wellbores are typically drilled and extended from a primary or main wellbore. The main wellbore can be vertical, deviated, or horizontal. Multibranch technology can be applied to both new and existing wells, and provides operators several benefits and economic advantages over drilling entirely new wells from the Earth's surface. For example, multibranch technology can allow isolated pockets of hydrocarbons, which might otherwise be left in the ground, to be tapped into. In addition, multibranch technology allows the improvement of reservoir production, increases the volume of recoverable reserves, and enhances the economics of marginal pay zones. By using multibranch technology, multiple reservoirs can be produced simultaneously, thus facilitating heavy oil production. Thin production intervals that might be uneconomical to produce alone become economical when produced together with multibranch technology. Consequently, it has become a common practice to drill deviated, and sometimes horizontal, branch boreholes from a main wellbore in order to increase production from a well.

In addition to production cost savings, development costs also decrease through the use of existing infrastructure, such as surface equipment and the wellbore. Multibranch technology expands platform capabilities where space is limited, and allows more wellbores to be added to produce a reservoir without requiring additional drilling and production space on the platform. In addition, by sidetracking depleted formations or completions, the life of existing wells can be extended. Finally, multibranch completions accommodate more wells with fewer footprints, making them ideal for environmentally sensitive or challenging areas.

The primary wellbore may be sidetracked to produce the branch borehole into another production zone. Further, a branch wellbore may be sidetracked into a common production zone. In sidetracking, a whipstock and mill assembly is used to create a window in the wall of the casing of a primary wellbore. The branch wellbore is then drilled through this window out into the formation where new or additional production can be obtained.

Once the branch wellbore has been drilled, various methods are employed for completing the well such that production via the branch wellbore can commence. For example, a tie-back assembly may be disposed adjacent the junction of the branch borehole and primary wellbore, as discussed in U.S. Pat. No. 5,680,901. The tie-back assembly and liner limit the exposure of the formation through the window cut in the casing. Similarly, U.S. Pat. No. 5,875,847 discloses a multibranch sealing device comprising a casing tool having a branch root premachined and plugged with cement. A profile receives a whipstock for the drilling of the branch borehole through the branch root and cement plug. A branch liner is then inserted and sealed within the branch root.

If the formation is a solid formation, the branch borehole need not include a casing or liner and may be produced open hole. If the branch borehole is unconsolidated or unstable and would tend to cave in, the branch borehole may be cased off or include a liner to support the formation. For example, it is common in the prior art to run and set a liner in the branch borehole with the liner extending from the flowbore of the casing and down into the branch borehole.

There are a variety of additional configurations that are possible when performing multibranch completions that "tie back" the branch for production. For example, U.S. Pat. No. 4,807,704 discloses a system for completing multiple branch wellbores using a dual packer and a deflective guide member. U.S. Pat. No. 2,797,893 discloses a method for completing branch wells using a flexible liner and deflecting tool. U.S. Pat. No. 3,330,349 discloses a mandrel for guiding and completing multiple branch wells. Another method of completing the branch wellbore involves sealing a dropped-off downole liner with a tubular that is advanced through the main wellbore into the opening of the dropped liner. This is usually achieved by a tube string having a bent joint and a guide means, such as a mule shoe device disclosed by U.S. Pat. No. 7,011,151.

When sections of production tubing are run into a wellbore, they are often landed in a liner hanger or a packer to interconnect the sections with previously run sections of production tubing. A seal assembly is secured to the lower end of the production tubing string being run that will create a bonded seal with a receptacle in the packer or liner hanger. Bonded seals for connecting tubulars and conduits together are well known in the art, and an example of a bonded seal is described in U.S. Pat. No. 6,142,538.

Previous landing arrangements have featured a muleshoe that is secured to the lower end of the seal assembly. In this type of arrangement, a beveled kickover lug is fashioned onto the outer surface of the end of the muleshoe to help guide the tip of the muleshoe into the opening of the receptacle.

However, a problem associated with landing the seal assembly into the receptacle is that the exact location of the entry or opening of the receptacle is often unknown. If the wellbore is deviated, the seal assembly tends to engage the edge of the receptacle instead of entering it. In order to correct the problem, it is often necessary to axially reciprocate and/or to rotate the production string in order to achieve proper seating. This operation is time consuming and costly and may be difficult to do if production tubing is being run from a floating rig that is prone to sea-induced motion or is equipped with control lines or cables for various completion accessories.

Similarly, this type of apparatus lacks flexibility in dealing with problems associated with branch wellbores because it requires a "close tolerance" fit for the bonded seal. For example, because the opening of the branch wellbore is usually at a significant depth within a formation, the exact location, orientation, and other general information about the opening are unknown. Thus, techniques have been sought to guide the seal assembly into a proper seating within the receptacle.

From the forgoing, it may be seen that it would be desirable to provide a means for forming a seal between two tubulars that overcomes the deficiencies of the prior art. Therefore, it may be seen that it would be beneficial to provide improved well completion systems and methods. Such systems and methods may include an improved seal between downhole tubulars.

SUMMARY OF INVENTION

In one aspect, embodiments disclosed herein relate to a system for sealingly engaging multiple downhole tubulars that includes a first downhole tubular comprising an end for receiving a second downhole tubular; a guide assembly disposed on an end of the second tubular; and a swellable seal disposed on an outer surface of the guide assembly, wherein after the first tubular receives the second tubular, the swellable seal is activated to form an expanded circumferential seal between the first tubular and the second tubular.

In another aspect, embodiments disclosed herein relate to a method of sealing tubulars in a wellbore that includes drilling a main wellbore; forming a branch wellbore in hydraulic communication with the main wellbore; placing a first tubular in the branch wellbore; running a second tubular into the main wellbore, wherein the second tubular comprises: a guide assembly disposed on a distal end of the second tubular; and a swellable seal disposed on an outer surface of the guide assembly; directing the second tubular toward the first tubular until the guide assembly penetrates the first tubular; and activating the swellable seal to form a hydraulic seal between the first tubular and the second tubular.

Other aspects and advantages of embodiments disclosed herein will be apparent from the following description and the appended claims.

BRIEF DESCRIPTION OF DRAWINGS

A full understanding of the disclosure is obtained from the detailed description of embodiments described hereinbelow, and the accompanying drawings, which are given by way of illustration only and are not intended to limit the present disclosure.

DETAILED DESCRIPTION

It is to be understood that the various embodiments described herein may be used in various orientations, such as inclined, inverted, horizontal, vertical, etc., and in various configurations, without departing from the scope of the present disclosure. The embodiments are described merely as examples of useful applications, which are not limited to any specific details of these embodiments.

In the following description of the representative embodiments disclosed herein, directional terms, such as "above," "below," "upper," "lower," etc., are used for convenience in referring to the accompanying drawings. In general, "above," "upper," "upward," and similar terms refer to a direction toward the earth's surface from below the surface along a wellbore, and "below," "lower," "downward," and similar terms refer to a direction away from the Earth's surface along the wellbore (i.e., into the wellbore). Additionally, it is to be understood that the various embodiments described herein may be used in various orientations, such as inclined, inverted, horizontal, vertical, etc., and in various configurations, without departing from the scope of the present disclosure.

Figure 1:
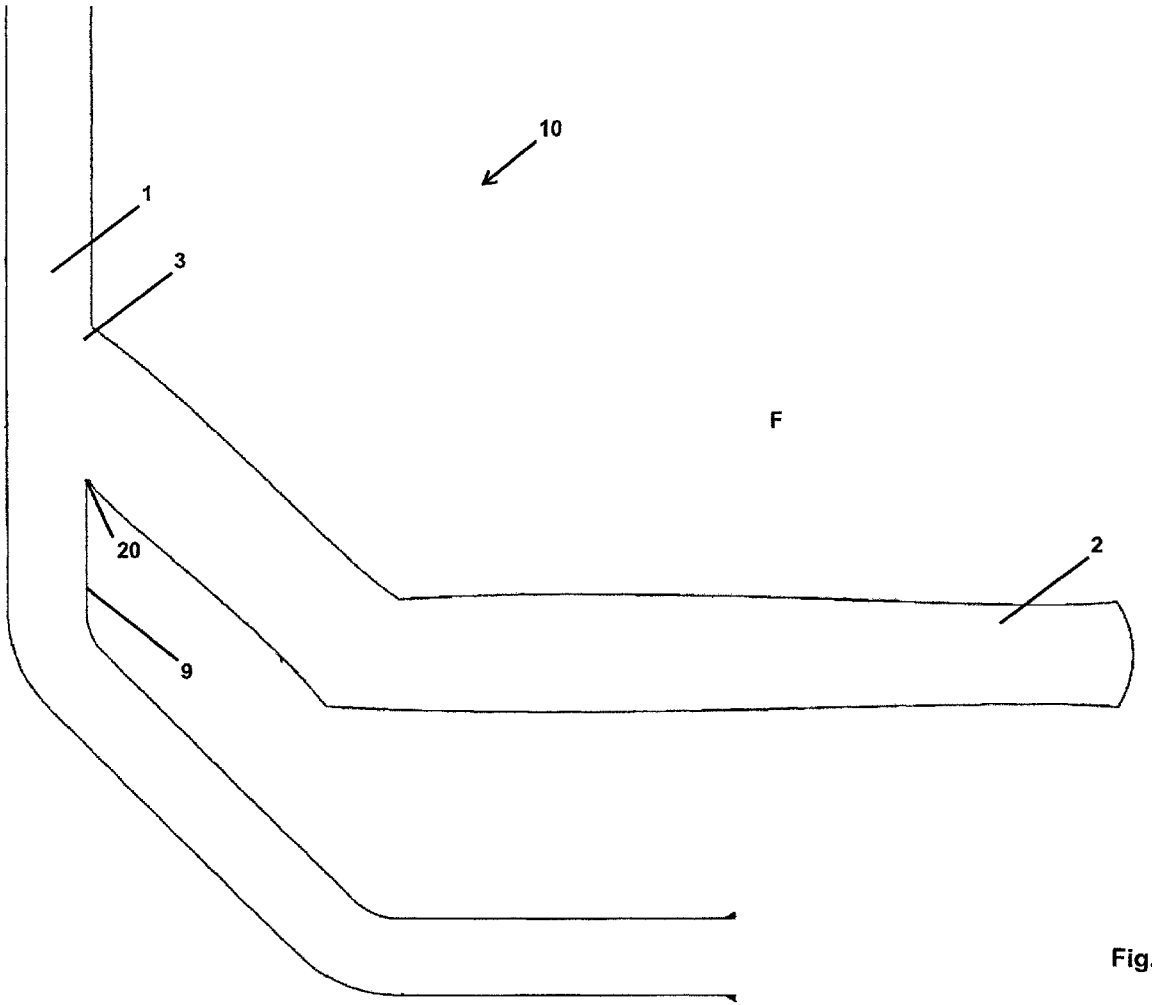
FIG. 1 shows a side cross-section view of a system of wellbores, in accordance with embodiments of the present disclosure.
Figure 2:
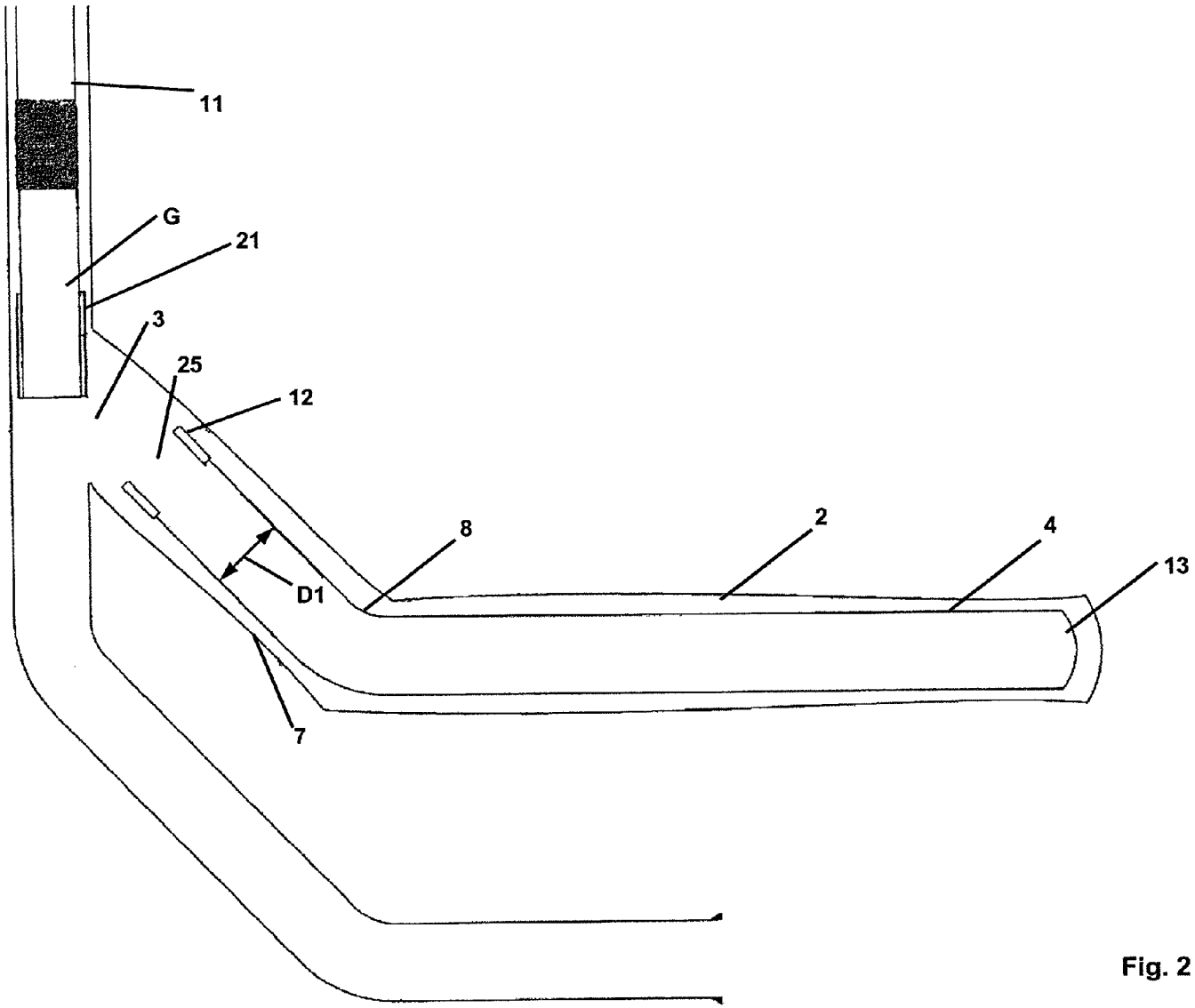
FIG. 2 shows a side cross-section view of a first tubular placed in a branch wellbore, and a second tubular advanced along a main wellbore, in accordance with embodiments of the present disclosure.
Figure 3:
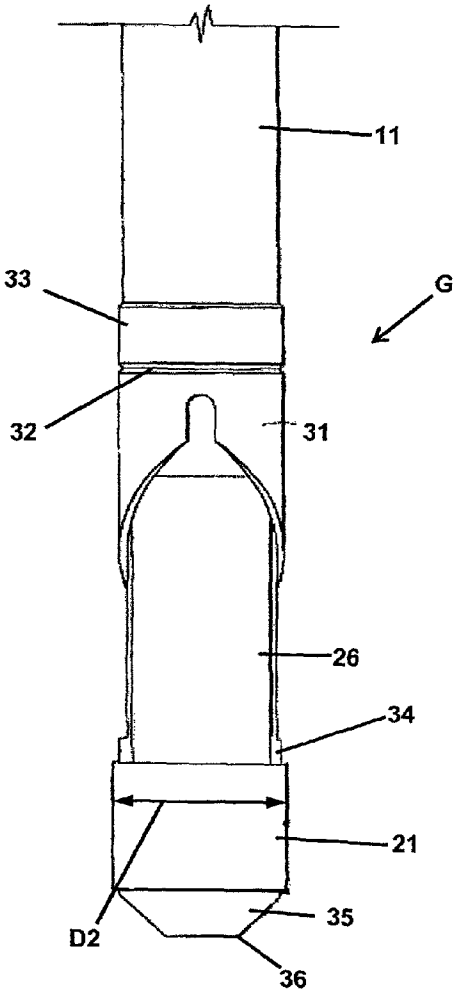
FIG. 3 shows an embodiment of a mule shoe assembly, in accordance with embodiments of the present disclosure.

Representatively illustrated in FIGS. 1-3 is a system 10 for sealingly engaging multiple downhole tubulars. As seen in FIG. 1, a main wellbore 1 extends down into a formation F, and may be lined with a string of casing (not shown). If the main wellbore 1 is cased, then the wellbore may be considered the interior of the casing. Such wellbores and the drilling of wellbores are well-known, as are the systems, tubulars, and methods for casing them. The formation F may contain hydrocarbons that are produced through at least a portion of the main wellbore 1 to a surface (not shown). While the main wellbore 1 may extend continuously to the surface, it may also be a branch of another wellbore (not shown).

FIG. 1 further shows a window 3 and a branch (e.g., lateral, secondary, horizontal, etc.) wellbore 2. The window 3 may be formed by anchoring a whipstock (not shown) in the main wellbore 1, and then deflecting a mill off of the whipstock to cut the window through a sidewall 9. The branch wellbore 2 is drilled extending outwardly from the window 3 formed in the sidewall 9 of the main wellbore 1. A junction 20 forms an intersection between the main and branch wellbores, which may be in hydraulic communication with one another.

FIG. 2 shows a first downhole tubular 4 (e.g., a liner string) disposed within the branch wellbore 2. In one embodiment, a near end 12 of the first tubular 4 may extend outwardly into the main bore 1. In addition, a distal end 13 of the first tubular 4 may extend to any desired length along the branch wellbore 2, including substantially all of the length of the branch wellbore 2. In one embodiment, the first tubular 4 is a drop-off liner or liner string.

As used herein, the term "liner string" is used to indicate any type of tubular string that lines a wellbore. A liner string may be comprised of continuous and/or segmented tubular members formed from metal (steel, aluminum, zinc, or alloys thereof) and/or non-metal materials (composite, fiberglass, plastic, or combinations thereof), and/or any other type of tubular string.

When necessary, the first tubular 4 may be sufficiently flexible for at least a portion 8 to bend or flex so the tubular 4 can enter into the branch 2 and conform to the shape of the bore. This is merely one example of a situation in which the embodiments of the disclosure herein may be applied. It should be clearly understood that it is not necessary in keeping with the embodiments disclosed herein for a liner string to be conveyed into a horizontal or highly deviated wellbore.

The first tubular 4 may be placed into the branch 2 by any means known in the art. For example, a work string (not shown), such as a string of drill pipe, coiled tubing, etc., may be used to convey the first tubular 4 into any portion of the drilled formation (including any of the wellbores) to any preferred position. While the liner and/or tubulars are shown run into the wellbore, it will be understood that embodiments of the system and method disclosed herein may include transporting tubulars into the wellbore using any number of means, such as coiled tubing or as otherwise known in the art.

The branch wellbore 2 may be completed for production by connecting a second downhole tubular 11 (or work string) with the first tubular 4. In one embodiment, the second tubular may be a production string. In another embodiment, the second tubular may be a work string. As shown by FIG. 2, the second tubular 11 is advanced downward towards the window 3 of the main wellbore 1. When the end of the tubular has reached the appropriate depth, a guide assembly G disposed on an end of the second tubular 11 directs the tubing through the window and toward near end 12 of the liner string that has an opening 25 configured to receive the second downhole tubular. In one embodiment, the near end 12 is a polished bore receptacle. The tubular 11 may also be directed by the deflector or whipstock, or alternatively, may be directed by a bent sub mechanism.

FIG. 3 depicts an embodiment of the guide assembly G that includes a mule shoe 26, as well as a swellable seal 21 made of a swelling material disposed circumferentially around at least a portion of the guide assembly G. In one embodiment, the swellable seal may be adhered externally to the mule shoe. In another embodiment, the swellable seal is bonded to the guide assembly. In these embodiments, the first tubular 4 (FIG. 2) may be configured with an inner diameter D1 (FIG. 2) that is greater than the outer diameter D2 of the swellable seal 21 before the material is activated.

Figure 4:
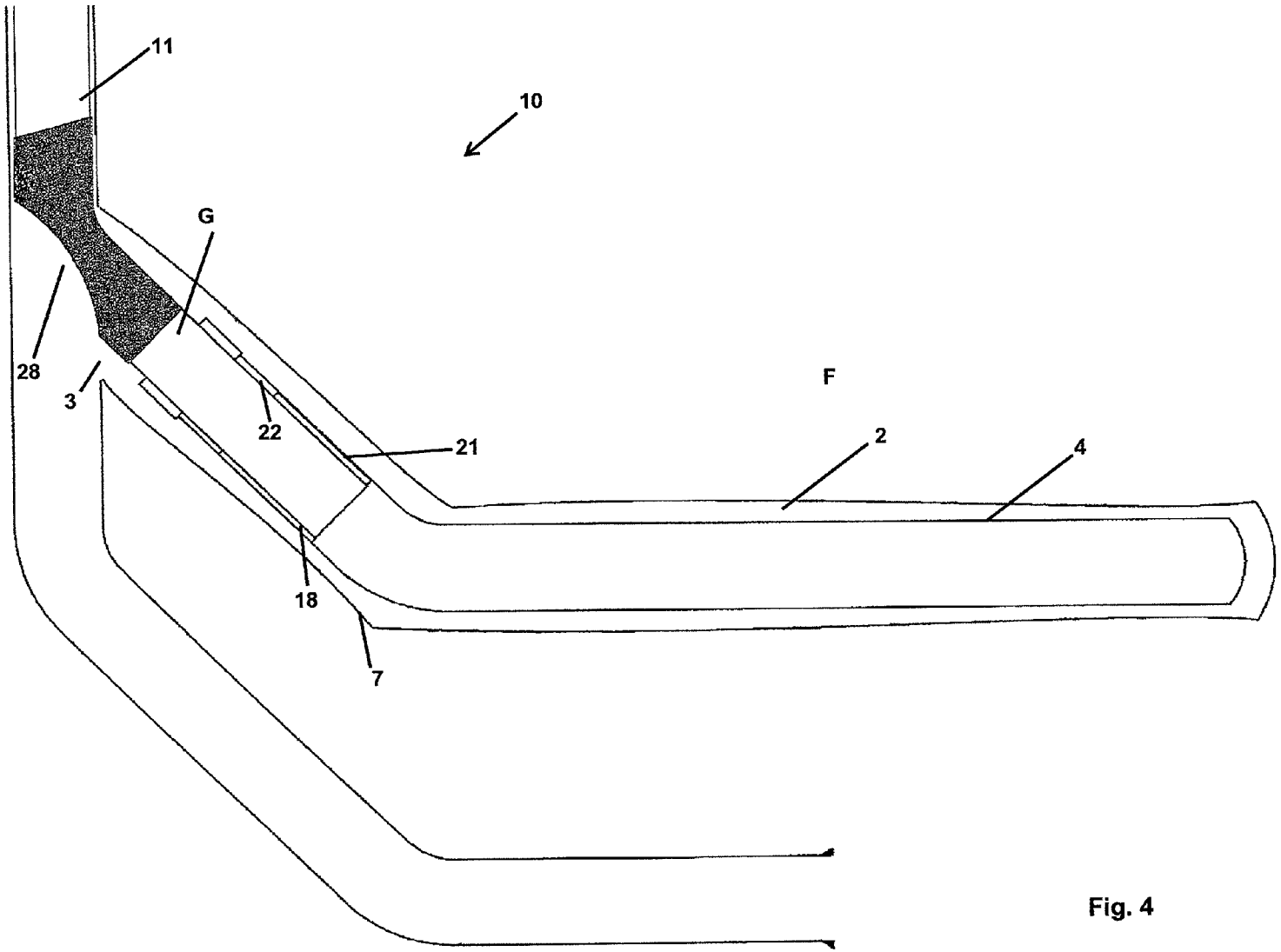
FIG. 4 shows a cross-section view of downhole tubulars sealingly engaged with each other, in accordance with embodiments of the present disclosure.

Other means of attaching the swellable seal 21 to at least a portion of the guide assembly may be used in keeping with the embodiments disclosed herein. Additionally, the swellable seal 21 is not limited to being transported into the wellbore by a guide assembly. The swellable seal may be disposed on any kind of conveyance device, tubing or tool that is configured so the swellable seal may swell to an expanded state 18 (FIG. 4). In addition, the conveyance device may also include coiled tubing or a tool deployed on a slickline or wireline. Further, there may be multiple swellable seals. For example, an additional swellable seal may be located on an exterior of a tubular.

Still referring to FIG. 3, the mule shoe 26 may be an assembly that includes a tubular body 31, with an upper end 32 of the tubular body 31 rotatably connected to a portion 33 of the second tubular 11. In one embodiment, the mule shoe assembly may also include a lower end 34 having an angled end-face 35 with a pointed tip 36, wherein the swellable seal 21 is disposed circumferentially around at least a portion of the pointed tip 36.

FIG. 4 is a section view of the system 10 illustrating the second tubular 11 with the guide assembly G on the lower portion thereof inserted or "stung" into the opening 25 (FIG. 2) of the first tubular 4. Once the guide assembly G has penetrated the first tubular to a selected depth, advancement of the production tubing is stopped. After the first tubular 4 receives the second tubular, the swellable seal 21 may then be activated to form an expanded hydraulic circumferential seal between the first tubular and the second tubular so that production may commence from the branch wellbore 2.

The swellable seal 21 may activate (i.e., swell) when exposed to an activating agent, such as fluids in the well. The type of activating agent that causes the swellable seal 21 to swell generally depends upon the properties of the seal material. The swellable seal 21 may swell in response to exposure to a hydrocarbonaceous fluid (such as oil or gas), or in response to exposure to water-based fluid. In one embodiment, the activating agent may be an oil-based mud, water-based fluids, hydrocarbonaceous fluids, or combinations thereof. In other embodiments, the activating agent may be a brine, production fluid, or drilling fluids (e.g., mud). The activating agent used to actuate the swelling of the swellable seal 21 may either be naturally occurring in the borehole itself, or specific fluids or chemicals that are pumped or injected into the borehole.

The activating agent may contact the swellable seal 21 using a variety of different techniques. For example, the activating agent may be present in the wellbores (e.g., produced into the wellbore from the formation F or naturally occurring in the wellbores, etc.), such that the activating agent may contact the swellable seal as the agent flows within the wellbore proximate the swellable seal 21. In another embodiment, the activating agent may be supplied through a control line (not shown), typically extending from a supply source at the surface and into the wellbore so that the activating agent may contact the swellable seal 21.

The swellable seal 21 may be made of a rubber compound or other materials known in the art. For example, the swellable seal 21 may be formed from nitrile, Viton®, Aflas®, Kalrez®, or ethylene-propylene rubbers (EPM or EPDM). Preferably, the swellable seal 21 increases in volume and expands radially outward when a particular fluid contacts the swellable seal 21.

In some embodiments, the expansion and/or swelling of the seal may take place either by absorption of the activating agent into the porous structure of the swelling material, or through chemical attack resulting in a breakdown of cross-linked bonds. In the interest of brevity, use of the terms "swell," "swollen" and "swelling" may also be indicative of "expanding."

Depending on the material used for the swellable seal 21, the swelling of the material to an expanded state 18 may be activated by a mechanism other than an activating agent. For instance, the expanding of the swellable seal may be activated by electrical polarization, in which case the swelling can be either permanent or reversible when the polarization is removed.

Continuing with FIG. 4, the system 10 is depicted after the swellable seal 21 has swollen in the annulus region 22 between the tubular 4 and the guide assembly G, as indicated by the expanded (e.g., swollen, etc.) swellable seal 21. While the first tubular 4 may be cemented in the branch wellbore 2 before forming the seal 21, it may also be cemented after activating the seal 21. In either case, once sealed, the tubular 4 may fluidly communicate with the surface of the well and hydrocarbons may follow a fluid path formed in first and second tubulars 4, 11.

In some embodiments, an operator may wish to release the activated swellable seal 21 from the expanded state 18. In this case, an operator may expose the swellable seal to a dissolving fluid which dissolves the swellable seal 21. The dissolving fluids may be transmitted to the swellable seal 21 by means and systems similar to those used to expose the activating agent to the swellable seal 21.

Embodiments disclosed herein pertain to a method of sealing tubulars in a wellbore that may include the steps of drilling a main wellbore, forming a branch wellbore in hydraulic communication with the main wellbore, placing a first tubular in the branch wellbore, running a second tubular into the main wellbore, wherein the second tubular may have a guide assembly disposed on a distal end of the second tubular, as well as a swellable seal disposed on an outer surface of the guide assembly. The method may also include the steps of directing the second tubular toward the first tubular until the guide assembly penetrates the first tubular to a selected depth within the first tubular, followed by activating the swellable seal to form a hydraulic seal between the first tubular and the second tubular. Advantageously, the selected depth in which the first tubular may be inserted into the second tubular may vary. In particular, the precise location of the first tubular within the second tubular may not be known in an effective seal may still be formed by activating the swellable seal.

In some embodiments, the directing step may be performed by a downhole positioned deflector that directs the second tubular into the branch wellbore toward the first tubular. In other embodiments, the directing step is performed by activating a bent sub assembly on the second tubular to direct the second tubular into the branch wellbore toward the first tubular. Other steps of the method may include forming an opening through the transition portion such that the main borehole is capable of hydraulic communication with the first tubular and/or second tubular. In one embodiment, the opening may be formed by drilling through a drillable transition portion.

As described, embodiments of the present disclosure provide systems and methods for completing a well using an expandable seal. Specifically, embodiments of the present disclosure may advantageously provide a seal between the upper end of a tubular sealingly engaged with a second tubular in a branch wellbore. The expanded seal may provide an effective hydraulic seal between the tubulars. Further, embodiments disclosed herein may advantageously provide a seal between tubulars when the exact location of the opening of the tubular is not known, thereby providing flexibility for the operator to complete a branch wellbore without the need to reciprocate or rotate the production string, as performed by previously used techniques.

While embodiments disclosed herein refer to a swellable seal between tubulars, the swellable seal may also be used in any instance wherein a hydraulic seal is needed.

While the foregoing is directed to embodiments of the present invention, other and further embodiments of the invention may be devised without departing from the basic scope thereof, and the scope thereof is determined by the claims that follow.

What is claimed is:

1. A system for sealingly engaging multiple downhole tubulars, comprising:

a first downhole tubular comprising an end for receiving a second downhole tubular;

a guide assembly rotatably connected to an end of the second tubular; and a swellable seal disposed on an outer surface of the guide assembly, wherein after the first tubular receives the second tubular, the swellable seal is activated to form an expanded circumferential seal between the first tubular and the second tubular.

2. The system of claim 1, wherein the first tubular is a drop-off liner, and the second tubular extends between the end of the drop-off liner to a surface.

3. The system of claim 1, wherein the swellable seal is activated by an activating agent comprising oil-based mud, water-based fluids, hydrocarbonaceous fluids, or combinations thereof.

4. The system of claim 1, wherein the swellable seal is a rubber compound that forms the expanded circumferential seal.

5. The system of claim 1, wherein the swellable seal is an ethylene-propylene rubber.

6. The system of claim 1, wherein the guide assembly is a mule shoe assembly that further comprises:

a tubular body comprising:

an upper end of the tubular body, wherein the upper end is rotatably connected to a portion of the second tubular; and a lower end of the tubular body comprising an angled end-face with a pointed tip, wherein the swellable seal is disposed circumferentially around at least a portion of the pointed tip.

7. The system of claim 1 further comprising:

a main wellbore;

a branch wellbore; and a junction formed between the main wellbore and the branch wellbore such that the main and branch wellbores are capable of hydraulic communication with each other, and wherein the first tubular is a drop-off liner positioned in the branch wellbore.

8. The system of claim 7, wherein the first tubular has a second swellable seal disposed around an exterior of the first tubular.

9. The system of claim 1 further, wherein the second tubular further comprises a bent sub assembly for directing the second tubular into the branch wellbore toward the first tubular.

10. The system of claim 1, wherein the first tubular has an inner diameter that is greater than the outer diameter of the swellable seal before the seal is activated.

11. The system of claim 1, wherein the guide assembly comprises a mule shoe assembly.

12. The system of claim 1, wherein the guide assembly comprises a pointed tip, and the swellable seal is disposed circumferentially around at least a portion of the pointed tip.

13. A method of sealing tubulars in a wellbore comprising:

drilling a main wellbore;

forming a branch wellbore in hydraulic communication with the main wellbore;

placing a first tubular in the branch wellbore;

running a second tubular into the main wellbore, wherein the second tubular comprises:

a guide assembly rotatably connected to a distal end of the second tubular; and a swellable seal disposed on an outer surface of the guide assembly;

directing the second tubular toward the first tubular until the guide assembly penetrates the first tubular; and activating the swellable seal to form a hydraulic seal between the first tubular and the second tubular.

14. The method of claim 13, wherein the first tubular is a drop-off liner.

15. The method of claim 13, wherein the activating comprises introducing an activating agent comprising oil-based mud, water-based fluids, hydrocarbonaceous fluids, or combinations thereof into contact with the swellable seal.

16. The method of claim 13, wherein the swellable seal is a rubber compound.

17. The method of claim 13, wherein the swellable seal is an ethylene-propylene rubber.

18. The method of claim 13, wherein the guide assembly is a mule shoe assembly that further comprises:

a tubular body comprising:

an upper end of the tubular body, wherein the upper end is rotatably connected to a portion of the second tubular; and a lower end of the tubular body comprising an angled end-face with a pointed tip, wherein the swellable seal is disposed circumferentially around at least a portion of the pointed tip.

19. The method of claim 13, further comprising the step of:

positioning a downhole deflector in the main wellbore.

20. The method of claim 13, wherein the directing step is performed by a bent sub assembly operatively connected to the second tubular.

21. The method of claim 13, wherein the second tubular further comprises a drillable transition portion.

22. The method of claim 21, further comprising the step of forming an opening through the transition portion such that the main borehole is capable of hydraulic communication with the first tubular and/or second tubular.

23. A system for sealingly engaging multiple downhole tubulars, comprising:

a first downhole tubular comprising an end for receiving a second downhole tubular;

a guide assembly disposed on an end of the second tubular; and a swellable seal disposed on an outer surface of the guide assembly, wherein:

after the first tubular receives the second tubular, the swellable seal is activated to form an expanded circumferential seal between the first tubular and the second tubular, the guide assembly comprises a mule shoe assembly, the mule shoe assembly comprises a tubular body comprising an upper end and a lower end, the upper end is rotatably connected to a portion of the second tubular, the lower end of the tubular body comprises an angled end-face with a pointed tip, and the swellable seal is disposed circumferentially around at least a portion of the pointed tip.

24. A method of sealing tubulars in a wellbore comprising:

drilling a main wellbore;

forming a branch wellbore in hydraulic communication with the main wellbore;

placing a first tubular in the branch wellbore;

running a second tubular into the main wellbore, wherein the second tubular comprises:

a guide assembly disposed on a distal end of the second tubular, the guide assembly comprising a tubular body having an upper end rotatably connected to a portion of the second tubular and a lower end comprising an angle end face with a pointed tip; and a swellable seal disposed on an outer surface of the guide assembly and being disposed circumferentially around at least a portion of the pointed tip;

directing the second tubular toward the first tubular until the guide assembly penetrates the first tubular; and activating the swellable seal to form a hydraulic seal between the first tubular and the second tubular.

* * * * *